United States Patent [19]

Westphal

[11] Patent Number: 4,469,241

[45] Date of Patent: Sep. 4, 1984

[54] TAMPER AND CHILD-RESISTANT CONTAINER

[76] Inventor: Scott Westphal, 1 Battleridge Trail, Totowa, N.J. 07512

[21] Appl. No.: 510,328

[22] Filed: Jul. 1, 1983

[51] Int. Cl.[3] ..... B65D 43/20

[52] U.S. Cl. ..... 220/346; 220/257; 220/266

[58] Field of Search ..... 220/345, 346, 8, 257, 220/266; 229/75 C; 206/1.5

[56] References Cited

U.S. PATENT DOCUMENTS

| | | | |
|---|---|---|---|
| 2,253,565 | 8/1941 | Kinsman . | |
| 2,273,999 | 2/1942 | Rueger . | |
| 2,295,747 | 9/1942 | Mills . | |
| 3,707,274 | 12/1972 | Hausler . | |
| 3,854,649 | 12/1974 | Wagner et al. . | |
| 3,927,820 | 12/1975 | Wagner et al. . | |
| 3,942,630 | 3/1976 | Phillips | 220/346 |
| 3,949,899 | 4/1976 | Jacobs et al. | 220/346 |

*Primary Examiner*—George T. Hall

*Attorney, Agent, or Firm*—Kenyon & Kenyon

[57] ABSTRACT

A tamper-resistant, child-resistant container having a lid slidably secured to a receptacle is disclosed. The lid is provided at one end with a flap or tongue perpendicular to the plane of the lid and parallel to a side of the receptacle in a locked state of the container. Upon an attempt to unlock or initially reclose the container, ribs on the flap undergo a visible deformation. In addition to or alternatively to the ribs, the lid may be provided with one or more scores, perforations, notches or incisions, or otherwise weakened, causing a severance of the flap upon an initial opening and/or attempted reclosure of the container. The container can also include a child-resistant feature provided by frictional engagement of the lid and receptacle.

24 Claims, 9 Drawing Figures

Fig. 1.
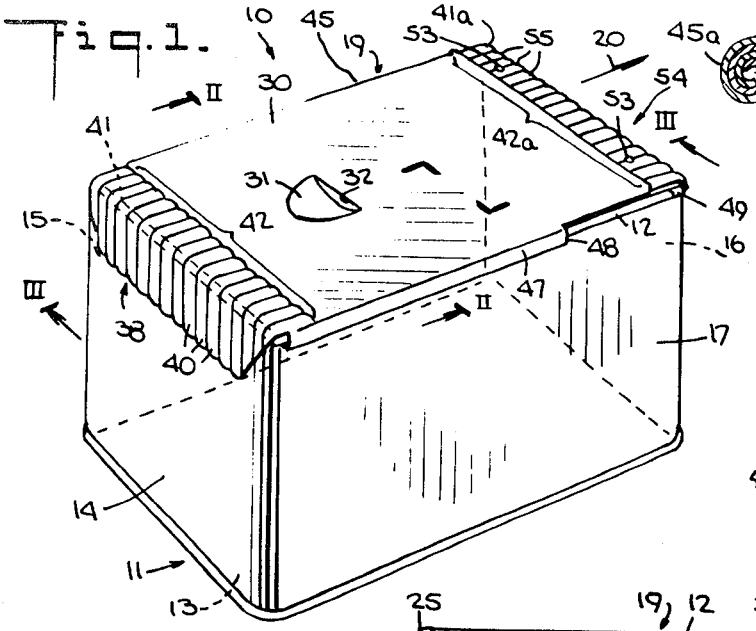
Fig. 7.
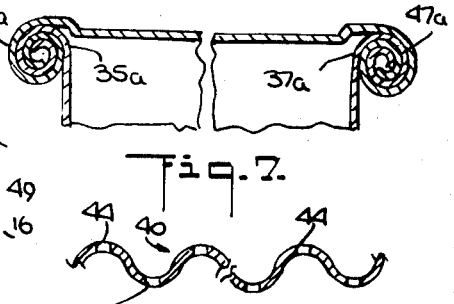
Fig. 8.
Fig. 9.
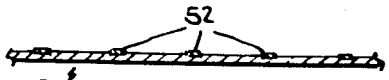
Fig. 3.
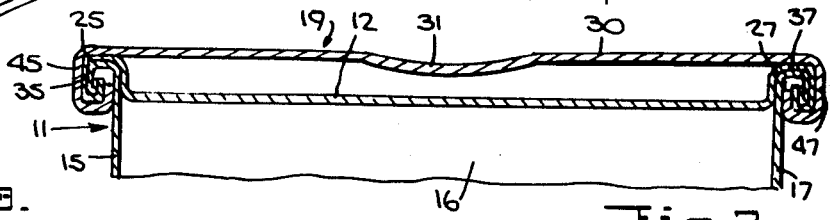
Fig. 2.
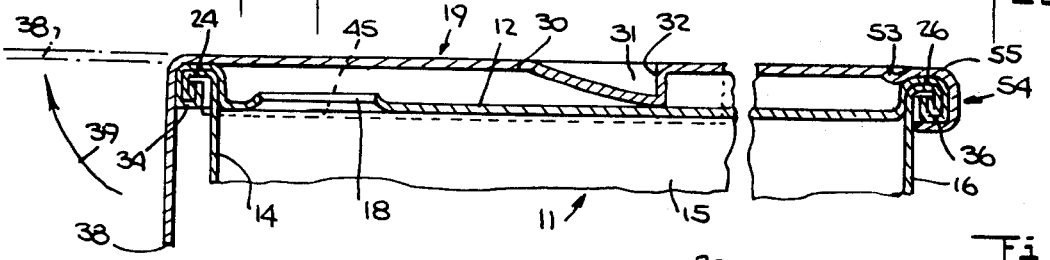
Fig. 4.
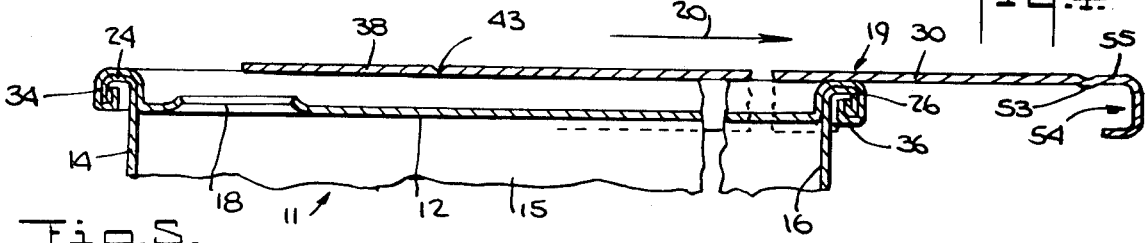
Fig. 5.
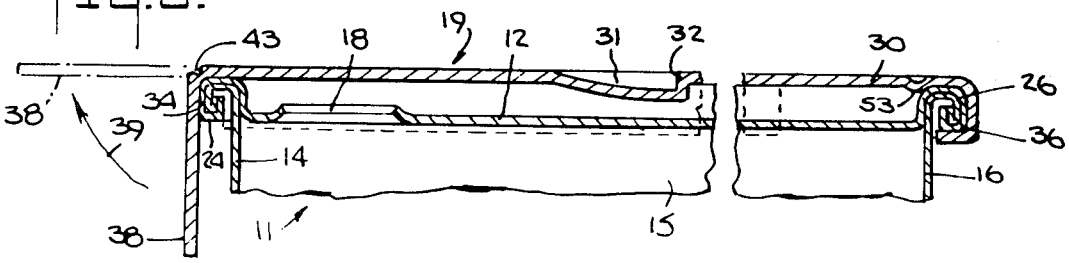
Fig. 6.
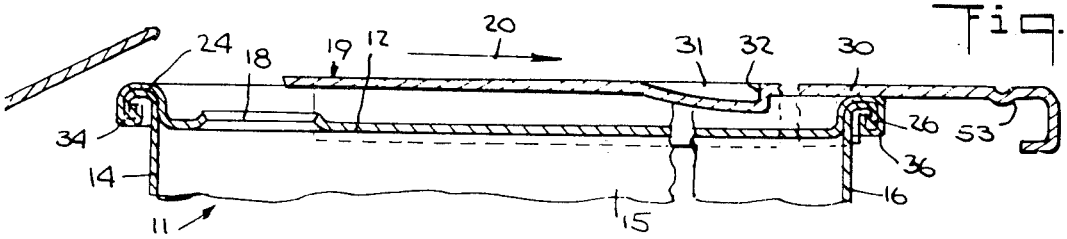

TAMPER AND CHILD-RESISTANT CONTAINER

BACKGROUND OF THE INVENTION

The present invention relates generally to a tamper-resistant container, and to a child-resistant container, and more particularly to such containers which include a receptacle and a lid slidably secured thereto.

Recent events in which unauthorized persons have opened containers and tampered with products in the containers have demonstrated the need for tamper-resistant containers.

There is also a need for child-resistant containers of the type which include a receptacle and a lid slidably secured thereto.

OBJECT AND SUMMARY OF THE INVENTION

It is an object of this invention to provide a tamper-resistant container having a sliding lid.

The above and other objects are achieved by the invention disclosed herein which provides means or structure associated with the container which undergoes visible deformation upon the initial sliding or moving of the lid or the initial attempt to reclose the container. The means or structure may be secured to or form part of the lid, a product-containing portion of the container or both.

Preferably the container includes further means or structure which limits sliding of the lid in one direction. However, in an embodiment in which the lid can be slid in either of two opposite directions, deforming means or structure are provided which undergo deformation upon initial sliding of the lid in either direction (or an initial reclosing of the container).

A tamper-resistant container according to the invention comprises a base defining a volume for holding a product, a lid slidably engaged with the base and means associated with the base and/or lid which undergoes at least a partially irreversible deformation upon an initial sliding or moving of the lid or an initial attempt to reclose the container. The base is fully open in one region or has an aperture communicating with the volume. Two substantially parallel edge portions are provided which define a plane extending adjacent the open region of the base or the aperture. The lid has two spaced-apart edges extending substantially parallel to each other. Means are provided associated with said two base edges and said two lid edges for slidably securing said lid to said base overlying said open region or aperture. The deformable means engage the base and/or the lid over a substantial portion thereof upon relative movement of the base and the lid and includes structure which undergoes at least partially irreversible deformation when the lid is initially slid or moved relative to the base or upon initially reclosing the container.

The deformable means is preferably connected to either or both the base and the lid. When connected to either the base or lid, the deformable means is engagable by the other upon relative movement of the base and lid. More preferably, the deformable means is connected to the lid and extends to be engagable by the base.

In a preferred embodiment, the lid has a body portion and an end or tongue portion angled with respect to the body portion and overlaying at least a portion of the base, the end portion being structured to permanently deform upon the application of force in a direction to engage the end portion of the lid with the base.

In one embodiment, the lid includes deformable ribs extending from either the lid or base. Preferably, the ribs are connected to the lid and extend to overlay the base. In other embodiments, the lid, the base or the deformable means includes a weakened portion, e.g. a reduced material portion which is notched, scored or perforated, separating the lid and/or base from the deformable means. In still another embodiment, the lid includes both the ribs and the weakened portion.

In the illustrated embodiments, the container includes a box-shaped receptacle and a planar lid having a pair of parallel, opposed hook-shaped flanges slidably engaging respective longitudinally extending guide rails or bead sections on the rim of the receptacle. In accordance with a preferred embodiment, a first arrest is provided for resisting motion of the lid in one direction parallel to the receptacle guide rails in the initially locked state of the container, and a second arrest is provided for resisting motion of the lid in an opposite direction parallel to the receptacle guide rails in the locked state of the container. At least one of the arrests is in the form of a flap or tongue on the lid extending, in the locked state of the container, perpendicularly to the body of the lid and parallel to a juxtaposed side of the receptacle and with which the deformable means or structure are associated. One or more ribs each disposed extending from the body of the lid and to the flap, or a weakened portion of the lid in the area that the flap is joined to the lid body, or both, are provided as the deformable means or structure which at least partially irreversibly deform upon an initial sliding of the lid in a direction to engage the flap with the body of the container, or upon a initial reclosing of the container. A plurality of ribs are preferably embossed on portions of the lid, extend perpendicularly to the joint between the lid body and the flap and are laterally contiguous with one another. The ribs may be provided with weakened portions in the area of the joint between the flap and the lid body.

It is another object of this invention to provide a child-resistant container having a sliding lid.

Child-resistant means are provided in accordance with the invention to achieve this object. The child-resisting means inhibits sliding of the lid, and according to preferred embodiments comprises one or more projections beads or bosses on the lid and/or receptacle for engaging the two when the lid is slid. The resistance is sufficient to prevent or at least make difficult the sliding of the lid by a child.

A container having tamper-resisting means and/or child-resisting means in accordance with this invention may be made of metal, cardboard, plastic or other materials.

The above and other objects, features, aspects and advantages of the present invention will be more readily perceived from the following description of the preferred embodiments thereof when considered with the accompanying drawings and appended claims.

BRIEF DESCRIPTION OF THE DRAWINGS

The present invention is illustrated by way of example and not limitation in the figures of the accompanying drawings in which like numerals indicate similar parts and in which:

FIG. 1 is a perspective view of a container with a slidable lid having tamper-resistant means in accordance with this invention;

FIG. 2 is a partial cross-sectional view taken along line II—II in FIG. 1;

FIG. 3 is a partial cross-sectional view taken along line III—III in FIG. 1, showing the lid of FIG. 1 in a closed and locked condition;

FIG. 4 is a view similar to FIG. 3, showing the lid of FIGS. 1 and 3 in a partially opened position;

FIG. 5 is a view similar to FIG. 3, showing a container lid in accordance with another embodiment of the present invention, in a closed and locked position;

FIG. 6 is a view similar to FIG. 3, showing the lid of FIG. 5 upon an initial opening thereof;

FIG. 7 is a cross-sectional view, similar to that of FIG. 2, showing another arrangement for fastening the top of the container receptacle to the receptacle;

FIG. 8 is a cross-sectional view of the ribs depicted in FIG. 1 showing a perforation extending transversely through the ribs; and FIG. 9 is a cross-sectional view of a flange or tongue of a lid according to another embodiment of the present invention.

DESCRIPTION OF THE PREFERRED EMBODIMENTS

As illustrated in FIG. 1, a container 10 provided with tamper-resisting means in accordance with this invention comprises a receptacle or base 11 in the form of a rectangular prism or box having a rectangular bottom 13 and four rectangular sides 14, 15, 16 and 17 extending upwardly from the bottom 13. The upper edges of the sides 14–17 form an upper perimeter which can be left fully open or can be closed by a top 12 provided with an aperture 18 (FIG. 3). A lid 19 is slidably engaged with the receptacle 11 so that upon sliding of the lid 19 relative to receptacle 11 in a direction indicated by arrow 20 (FIGS. 1, 4 and 6), the contents of the receptacle can be removed through aperture 18 if top 12 is provided, or through the fully opened upper perimeter of the receptacle. The receptacle can be formed as a single piece or can be formed from two or more pieces joined together. If desired, the aperture 18 in the receptacle top 12 can be sealed by a plastic or paper member or the like secured to the top by, for example, an adhesive, to prevent contamination of product and leakage of product from the container during shipment and storage. If the upper perimeter of the receptacle is left fully open, the seal member can be secured to the upper edges of the sides or to the sides themselves. The seal member also serves a tamper-resistant function in that it is difficult to replace the seal member once it is broken.

As shown in FIGS. 2 and 3, the upper edge of each side 14, 15, 16 and 17 of receptacle 11 has a flange 24, 25, 26 and 27, respectively, which is rolled over outwardly to form a continuous bead around the upper perimeter of receptacle 11. Peripheral flanges or edge portions 34, 35, 36 and 37 of the top 12, when used, are crimped or rolled around respective rolled-over flanges 24, 25, 26 and 27 of sides 14, 15, 16 and 17, whereby top 12 is secured to these sides. The top 12 can also be adhered or applied to the sides in other ways.

Rolled-over or crimped edge portions 35 and 37 of top 12, when provided, or edge portions 25, 27 of sides 15, 17, respectively, form a pair of parallel rails which guide lid 19 as it is slid relative to receptacle 11 during an opening or closing stroke thereof. Guide rails 35 and 37 (or 25 and 27) are slidably engaged by respective flanges 45 and 47 (FIG. 2) of lid 19 which flanges are bent downwardly, then inwardly and/or then upwardly from a plane defined by a main portion or body 30 of lid 19. As shown in FIG. 2, rolled-over lid flanges 45 and 47 are substantially C-shaped in cross section and surround guide rails 35 and 37 (or 25 and 27) of the receptacle. The interlocking nature of the lid flanges and guide rails serves a further tamper-resistant function in that it is difficult to unlock, particularly without detection, the flanges and guide rails, which unlocking could permit pivoting of the lid relative to the receptacle so as to provide access to the interior of the receptacle. To further interlock the lid and the receptacle, a turned-in hook or spiral arrangement (35*a*, 45*a*; 37*a*, 47*a*) as shown in FIG. 7, can be used. In such an arrangement, both the lid flanges 45*a*, 47*a* and the guide rails 35*a*, 37*a* are bent, sharply or curved, in a spiral path. Other arrangements for slidably interlocking the lid and the receptacle can also be used.

Lid 19 is provided with an indentation or recess 31 in an upper surface of the lid body 30 for facilitating manual opening of the container. A thumb or finger is engagable with a shallow wall 32 defining one end of recess 31 and extending perpendicularly to the plane of lid body 30. As illustrated in FIGS. 2, 3, 5 and 6, recess 31 is preferably formed by embossing a part of lid body 30. When top 12 is provided, the indentation 31 can be made sufficiently deep so as to contact and frictionally engage the top 12, as depicted in FIG. 3. By appropriately setting the frictional engagement, the indentation 31 can be made to provide a child-resistant feature.

Lid 19 is provided at one end with a substantially planar tongue or flap portion 38 which is contiguous with lid body 30 and which is oriented, in a locked state of the container assembly, perpendicularly to lid body 30 and parallel to and overlaying receptacle side 14. Preferably, tongue 38 is formed integrally with lid body 30 along an elongate area 42 extending parallel to side 14 of the receptacle base 12. Tongue 38 can, however, be joined to lid body 30 in other ways. In order for the container assembly to be unlocked, i.e., opened for the first time, tongue 38 must be swung in the direction of arrow 39 (FIGS. 3 and 5), i.e., from its container-locked position towards the plane defined by lid body 30 and away from receptacle side 14. This occurs when the lid is slid and tongue 38 engages the edge of the top 12 (or the edge of the receptacle side 14 if the top is not provided), as described below. The tongue 38 engages the top edge or receptacle side over a substantial and continuous portion 41 of the tongue. The tongue 38 is pivoted about the elongate and continuous portion 41 extending adjacent the edge of side 14 or top 12 during an unlocking operation.

Tongue 38 may be pivoted prior to an initial sliding of lid 19. However, a simpler method of unlocking the container assembly consists of a simultaneous sliding of the lid body 30 in the direction of arrow 20 which causes a pivoting of tongue 38 in the direction of arrow 39, owing to a sliding engagement of the portion 41 in the underside of tongue or flap 38 with edge 34 of top 12 (or the upper edge of side 14 if the top is not provided).

Lid 19, or more precisely tongue 38, is provided in the region of portion 41 with tamper-resisting means which undergo a permanent deformation upon an unlocking or initial reclosing of the container assembly.

As illustrated in FIG. 1, lid 19 is provided with a plurality of ribs 40 each extending from the lid body 30, bent along area 41 and over the edge of the top 12 (or the top edge of side 14), and extending along and overlaying receptacle side 14. Preferably, ribs 40 extend perpendicular to the elongate dimension of elongate area 42 and are formed integral with lid 19 by embossing or molding. As shown in FIG. 1, moreover, ribs 40 are preferably laterally contiguous with one another. Upon an initial stroke of the container, i.e., a sliding of the lid in the direction of arrow 20 (FIGS. 1 and 4), tongue 38 is forced to slide over the edge of top 12 (or the upper edge of side 14) and thereby pivots towards the plane of lid body 30. During the pivoting of tongue 38, ribs 40 undergo at least a partially irreversible deformation in the region of tongue portion 41 where the ribs have been bent. The deformation remains visible upon a subsequent closing of lid 19 and a pivoting of tongue 38 towards receptacle side 14. The deformation could take the form of dents, bulges, tears and other changes in the structure or appearance of the ribs, such as, for example, a discloration.

As an alternative to ribs 40, deformation can be induced by scoring lid 19 with a continuous or broken incision or notch 43 extending along the portion 41 of the tongue, as shown in FIG. 5. Alternatively, the tongue 38 can be perforated with perforations 44 cut through the ribs, preferably in the peak and valley portions of the ribs as shown in FIG. 8 and extending along tongue portion 41. The portion 41 of tongue 38 can be weakened in other manners and other configurations reducing the material content of the tongue 38 in portion 41 can be used. Upon a sliding of lid 19 during an attempt to unlock the container assembly, tongue 38 is severed from lid body 30, as illustrated in FIG. 6. In some cases, however, tongue 38 may remain attached to lid body 30 upon an initial opening of the container assembly. In such cases, the weakening of the lid material in the region of the portion 41, due to the presence of incision 43 or perforation 44, ensures a severance of tongue 38 from lid body 30 upon a subsequent attempt to return tongue 38 to the container-locked position shown in solid lines in FIG. 5.

As illustrated in FIG. 4, some or all of ribs 40 in region 41 can be of reduced material content, i.e. be provided with respective scoring, notches, incisions 43 or perforations 44. In this case, the ribs 40 can be deformed on the one hand, and partial or total severance of tongue 38 from lid body 30 can occur on the other hand.

As illustrated in FIG. 9, lid 19 and, in particular, tongue or flap 38, may be provided with ribs 52 which are structurally separate features. Ribs 52 can be attached to lid body 30 and tongue 38, as for example by a cold pressing operation. During an attempt to unlock and subsequently relock a container having tamper-resistant ribs 52, these ribs separate from the lid body and tongue 38 at least in portion 41 (FIG. 1). The ribs 52 cannot be returned to their original relationships with the lid, whereby an opening of the container can be readily detected upon inspection.

As shown in FIGS. 1 and 3–6, lid body 30 is provided on an underside with one or more beads or projections 53 frictionally engagable with receptacle 11 along the upper edge of receptacle side 16 or receptacle top 12, if provided. Upon an attempt to slide lid 19 from a closed position (FIGS. 1, 3 and 5), bead or beads 53 frictionally engage the receptacle to offer resistance to the continued movement of lid 19 in the direction of arrow 20 (FIGS. 1 and 4). This arresting effect is sufficient in many circumstances to deter a child from opening the container. Beads 53 are preferably formed as bosses on lid body 30. The beads 53 may be provided together with or in addition to the deep recess 31 shown in FIG. 3. Thus, the container includes a child-resistant feature provided by the beads 53 and/or the deep recess 31 shown in FIG. 3.

As illustrated in FIGS. 1 and 3–6, lid 19 is provided at an end opposite tongue 38 with a cross-sectionally C- or hook-shaped flange 54 for engaging rolled-over edge portion 36 to prevent motion of lid 19 in a direction opposite to arrow 20 in a closed state of the container. As illustrated in FIG. 1, hooked flange 54 is advantageously provided with a multiplicity of laterally contiguous ribs 55 extending over a bent or arcuate portion **41*a* of lid 19 to the body 30 of the lid. Ribs 55 are preferably embossed portions of lid 19. Ribs 55 extend from elongate area 42*a* of lid body 30 into engagement with the hooked flange of the receptacle. As for tongue 38, ribs 55 of flange 54 are bent along a portion 41*a*. Alternatively, flange 54 can be constructed identical or similar to tongue 38**.

Both of the bent sides, 47 & 45, of the lid can be shorter than the base curls so as to form a stop 48 engagable upon sliding the lid in the direction of arrow 20 with a projection 49 or the continuous base curl corner formed by edges 34,35 and 36,37 at respective corners of the container base. If top 12 is not provided, the continuous base curl corner can be formed by edges 25,26 and 27,28 of the container sides at respective corners of the container base. This prevents the lid from being separated from the receptacle.

The tongue 38 and flap 54 are shown connected to the lid. However, the tongue and/or flap or both can be connected to the receptacle instead, or to both the receptacle and the lid.

It is to be noted that a container according to this invention can be formed from many different materials including, not exclusively, metal, plastic and cardboard. The container can also take many different shapes while utilizing the invention disclosed herein.

Certain changes and modifications of the embodiments of the invention disclosed herein will be readily apparent to those skilled in the art. It is the applicant's intention to cover by his claims all those changes and modifications which could be made to the embodiments of the invention herein chosen for the purpose of disclosure without departing from the spirit and scope of the invention.

What is claimed is:

1. A tamper-resistant container comprising a base defining a volume for holding a product, the base having an opening communicating with the volume and two edge portions which are substantially parallel and define a plane extending adjacent the opening;

a lid having two spaced-apart edges extending substantially parallel to each other;

means associated with said two base edges and said two lid edges for slidably securing said lid to said base overlying said opening; and means engaging said base and said lid over a substantial portion thereof upon relative movement of the base and the lid including structure which permanently deforms upon said relative movement or an initial attempt to reclose the container.

2. The container according to claim 1 wherein said means is connected to one of said base and said lid and is engagable by the other upon said relative movement.

3. The container according to claim 2 wherein said means is connected to said lid and extends so as to be engagable by said base upon said relative movement.

4. The container according to claim 2 wherein said means includes deformable ribs extending substantially from one of said base and said lid.

5. The container according to claim 4 wherein said ribs are connected to said lid and extend overlaying said base so as to be engagable by the base upon said movement.

6. The container according to claim 2 where said means includes a weakened portion disposed adjacent said substantial portion of said base and said lid which are engaged upon said movement.

7. The container according to claim 2 wherein said means includes deformable ribs extending substantially from one of said base and said lid and overlaying the other, and a weakened portion disposed adjacent said substantial portion of said base and said lid are engaged upon said movement.

8. The container according to claim 1 wherein said base is a rectangular prism and said means includes a portion which extends at a right angle to one of said base and said lid.

9. The container according to claim 1 and including at least one projection extending from said lid and/or receptacle for engaging the two, thereby providing resistance to the sliding of the lid, whereby the container includes a child-resistant feature.

10. A tamper-resistant container comprising a base defining a volume for holding a product, the base having an opening communicating with the volume and two edge portions which are substantially parallel and define a plane extending adjacent the opening;

a lid having two spaced-apart edges extending substantially parallel to each other;

means associated with said two base edges and said two lid edges for slidably securing said lid to said base overlying said opening; and means connected to one of said base and said lid and extending so as to be engagable by the other of said base and said lid along a substantially continuous and substantial portion thereof upon relative movement of the base and the lid, said means including structure which permanently deforms upon said relative movement or an initial attempt to reclose the container.

11. A container assembly comprising a receptacle and a lid having a substantially planar body, said receptacle having a base and a multiplicity of sides extending from said base perpendicularly thereto, the upper edges of said sides defining a top, the body of said lid having a shape substantially identical to the shape of said top, said receptacle being provided at the upper edges of said sides and said lid being provided with means for slidably engaging the lid to the container, first arresting means partially disposed on the lid for resisting, in a closed state of the container assembly, motion of said lid relative to the receptacle in a first direction parallel to said top, second arresting means partially disposed on said lid for resisting, in a locked state of said container assembly, motion of said lid relative to said receptacle in a second direction opposite to said first direction, at least one of said arresting means including a tongue portion having at least one substantially planar portion integral with the body of said lid and oriented, in the locked state of said container assembly, substantially perpendicularly to the body of said lid and substantially parallel to a juxtaposed side of said receptacle, said tongue portion being joined to the body of said lid at an elongate area adjacent said juxtaposed side of said receptacle, and tamper-resisting means on said lid in a portion adjacent said elongate area for undergoing at least a partially irreversible deformation upon a bending of said tongue portion towards the plane of the body of said lid upon an unlocking of said container assembly or an initial reclosing of the container.

12. The container according to claim 11 and including means for closing a portion of the top.

13. The container according to claim 11 wherein said tamper-resisting means includes on said lid at least one rib extending from the body of said lid in said portion and along said tongue portion.

14. The container according to claim 11 wherein said tamper-resisting means includes a plurality of ribs extending parallel to each other from the body of said lid in said portion and along said tongue portion.

15. The container according to claim 14 wherein said ribs extend substantially perpendicularly to said portion.

16. The container according to claim 14 wherein said ribs are laterally contiguous with one another.

17. The container according to claim 13 wherein said rib is an embossed portion of said lid.

18. The container according to claim 13 wherein said rib is weakened in said portion.

19. The container according to claim 13 wherein said rib is a separate structural feature attached to said lid.

20. The container according to claim 11 wherein said lid includes at least one projection on an underside thereof and means on said receptacle for engaging said projection, thereby providing resistance to the sliding of said lid.

21. The container according to claim 11 wherein one of the arresting means is disposed substantially opposite said tongue portion and said receptacle includes means for interlocking the two in a locked state of said container assembly.

22. The container according to claim 11 wherein said portion has a long dimension and a short dimension and is weakened to cause a severing of said tongue portion from the body of said lid during an opening and a subsequent attempt to relock said container assembly.

23. The container according to claim 12 and including at least one projection extending from the body of the lid to and in engagement with said means closing the top, thereby providing resistance to the sliding of said lid.

24. The container according to claim 11 wherein said means for slidably engaging comprises a pair of parallel guide rails formed from respective opposed flanges of said receptacle and a pair of opposed flanges of said lid bent into an interlocking engagement.

* * * * *